US006162069A

United States Patent [19]

Choy

[11] Patent Number: 6,162,069

[45] Date of Patent: Dec. 19, 2000

[54] ROTATIVE INSTALLATION CARD EDGE CONNECTOR WITH GROUNDING DEVICE THEREOF

[75] Inventor: Edmond Choy, Union City, Calif.

[73] Assignee: Hon Hai Precision Inc. Co., Ltd., Taipei Hsien, Taiwan

[21] Appl. No.: 09/464,255

[22] Filed: Dec. 20, 1999

[51] Int. Cl.[7] ..... H01R 4/66

[52] U.S. Cl. ..... 439/92

[58] Field of Search ..... 439/92, 76.1, 74, 439/59, 64, 108, 328

[56] References Cited

U.S. PATENT DOCUMENTS

| | | | |
|---|---|---|---|
| 5,112,242 | 5/1992 | Choy et al. | 439/326 |
| 5,203,714 | 4/1993 | Tuan | 439/326 |
| 5,669,782 | 9/1997 | Yodogawa | 439/327 |
| 5,759,057 | 6/1998 | Cheng et al. | 439/328 |
| 5,779,494 | 7/1998 | Ito et al. | 439/326 |
| 5,888,086 | 3/1999 | Yaegashi et al. | 439/326 |
| 5,938,463 | 8/1999 | Yodogawa | 439/326 |
| 5,984,708 | 11/1999 | Yu | 439/326 |
| 5,997,330 | 12/1999 | Choy | 439/328 |
| 5,997,332 | 12/1999 | Choy | 439/328 |

*Primary Examiner*—Renee Luebke
*Assistant Examiner*—Phuongchi Nguyen
*Attorney, Agent, or Firm*—Wei Te Chung

[57] ABSTRACT

An SO DIMM connector includes an insulative housing (10) defining an elongated slot (12) along a longitudinal direction thereof. A plurality of passageways (14) are formed by two sides of the slot (12) in the housing (10). A plurality of contacts are received within the corresponding passageways with contact portions extending into the slot (12). A pair of supporting platform (16) are formed at two opposite ends of the housing (10). A pair of latch devices (22) are disposed on the corresponding supporting platforms (16), respectively. Each latch device (22) includes a plastic member (24) and a metal member (26) commonly deflectable with regard to the housing (10). A substrate module (100) is inserted into the slot (12). The module (100) defines a pair of notches (101) in two side portions and a pair of grounding pads (102, 106) respectively on both surfaces (104, 108) thereof around each of said notches (101). The plastic member (24) defines a locking protrusion (28) and a restriction protrusion (30) respectively abutting against the upper surface (104) and received within the notch (101) of the module (100), while the metal member (26) defines a pair of grounding tangs (44, 46) respectively engaged with the corresponding grounding pads (102, 106) on two opposite surfaces (104, 108) of the module (100).

2 Claims, 4 Drawing Sheets

ROTATIVE INSTALLATION CARD EDGE CONNECTOR WITH GROUNDING DEVICE THEREOF

BACKGROUND OF THE INVENTION

1. Field of the Invention

The invention relates to card edge connectors, and particularly to the SO DIMM connector having latches with grounding functions thereof.

2. The Related Art

U.S. Pat. No. 5,997,332 of the same inventor with the invention discloses the SO DIMM (Small Outline Dual In-line Memory Module) connector with a pair of latch devices at two ends of the housing. Each latch device includes a plastic member and a metal member wherein the deflectable plastic member includes a locking head for latchable engagement with the inserted module, while the metal member is supportably attached to the plastic member and moved along with the plastic member for supporting the plastic member.

Anyhow, recently the inserted module defines grounding pads thereon and is expected to be promptly grounded to the mother board on which the connector is seated. Therefore, an object of the invention is to provide an SO DIMM connector with latch devices wherein said latch device provides the grounding function.

SUMMARY OF THE INVENTION

According to an aspect of the invention, an SO DIMM connector includes an insulative housing 10 defining an elongated slot along a longitudinal direction thereof. A plurality of passageways are formed by two sides of the slot in the housing. A plurality of contacts are received within the corresponding passageways with contact portions extending into the slot. A pair of supporting platform are formed at two opposite ends of the housing. A pair of latch devices are disposed on the corresponding supporting platforms, respectively. Each latch device includes a plastic member and a metal member commonly deflectable with regard to the housing. A substrate module is inserted into the slot. The module defines a pair of notches in two side portions and a pair of grounding pads respectively on both surfaces thereof around each of said notches. The plastic member defines a locking protrusion and a restriction protrusion respectively abutting against the upper surface and received within the notch of the module, while the metal member defines a pair of grounding tangs respectively engaged with the corresponding grounding pads on two opposite surfaces of the module.

DETAILED DESCRIPTION OF THE PREFERRED EMBODIMENT

References will now be in detail to the preferred embodiments of the invention. While the present invention has been described with reference to the specific embodiment, the description is illustrative of the invention and is not to be construed as limiting the invention. Various modifications to the present invention can be made to the preferred embodiments by those skilled in the art without departing from the true spirit and scope of the invention as defined by appended claims.

Figure 1:
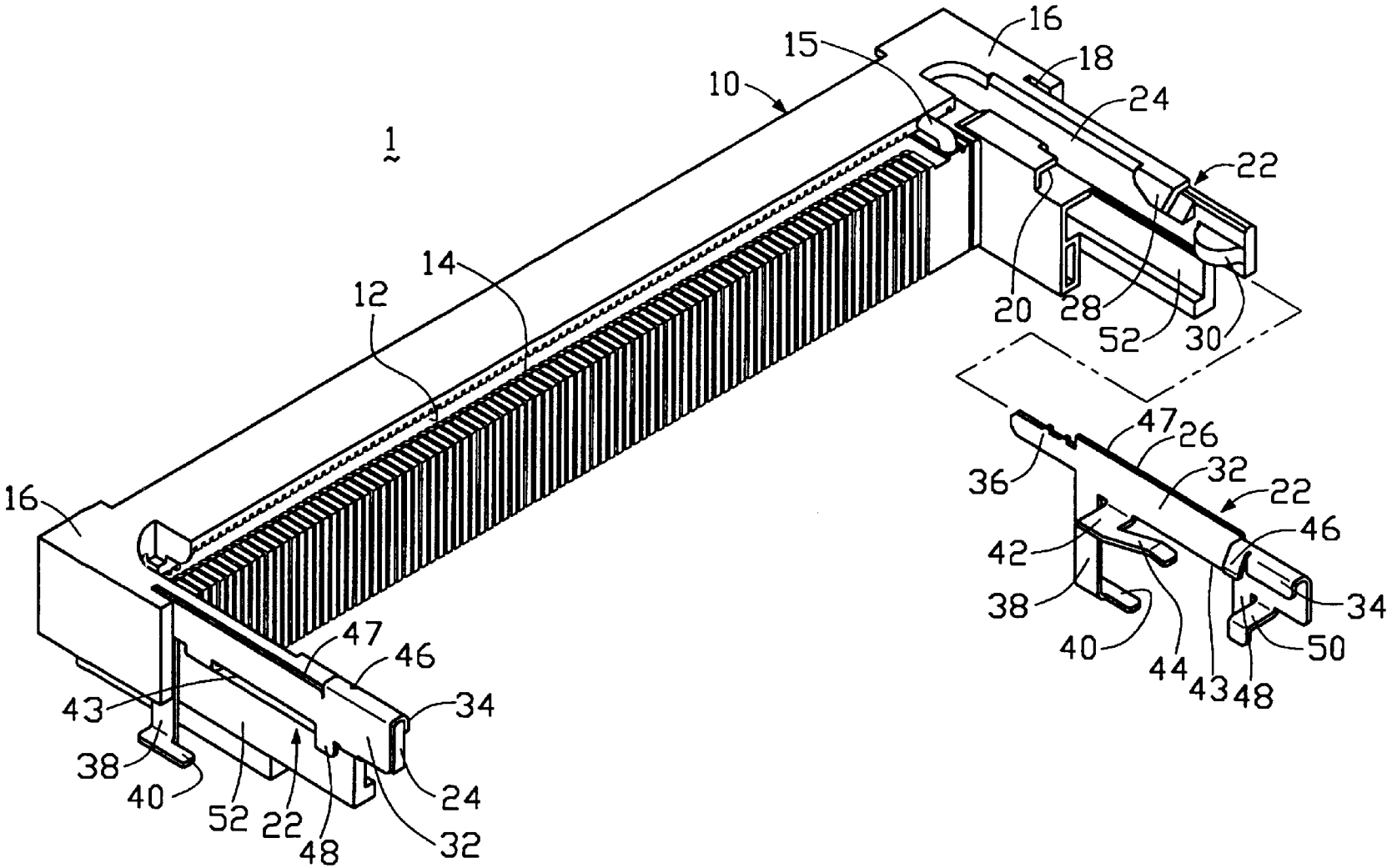
FIG. 1 is an exploded perspective view of a presently preferred embodiment of a card edge connector, according to the invention.
Figure 2:
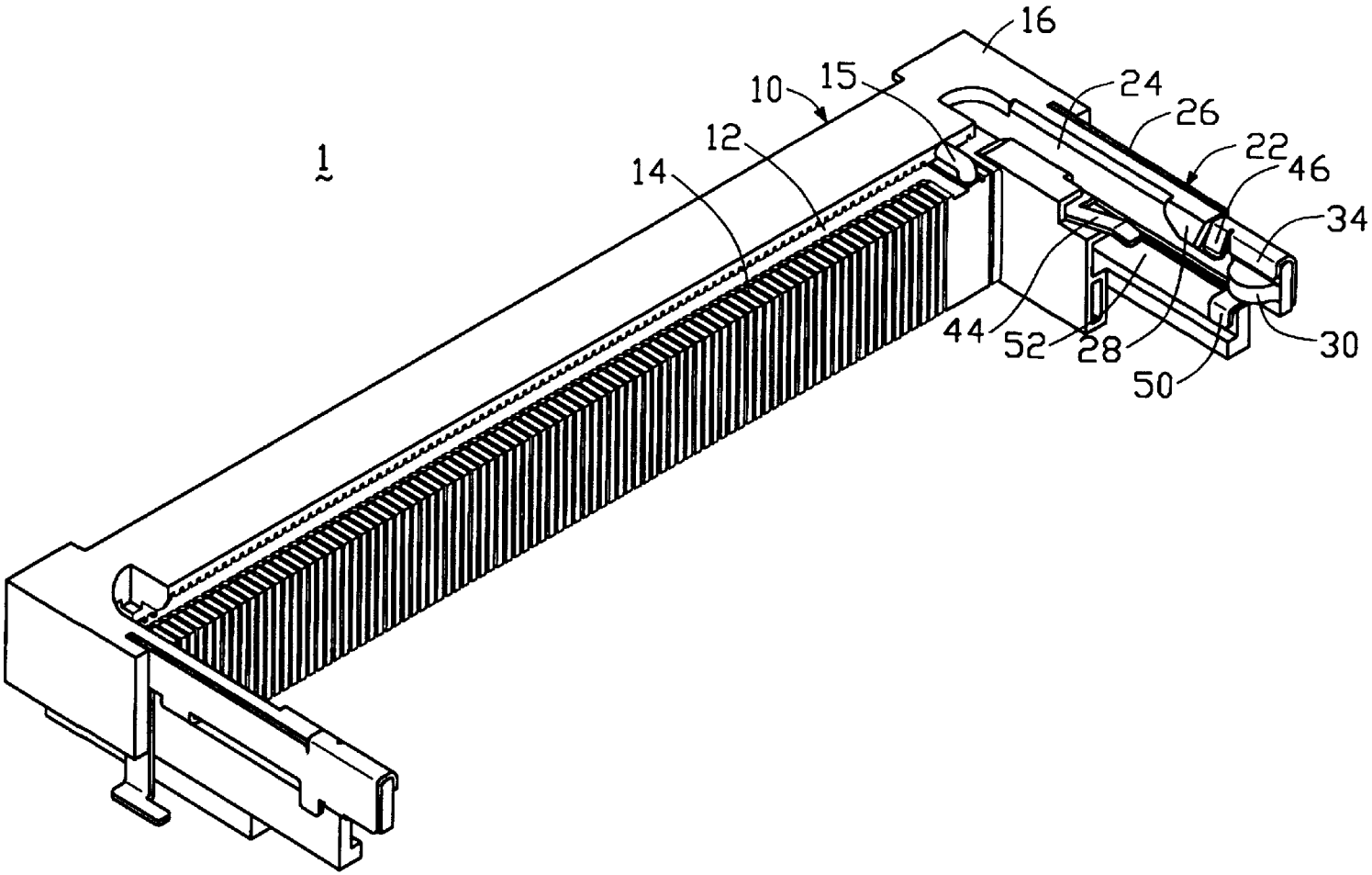
FIG. 2 is a perspective view of the assembled card edge connector of FIG. 1.
Figure 3:
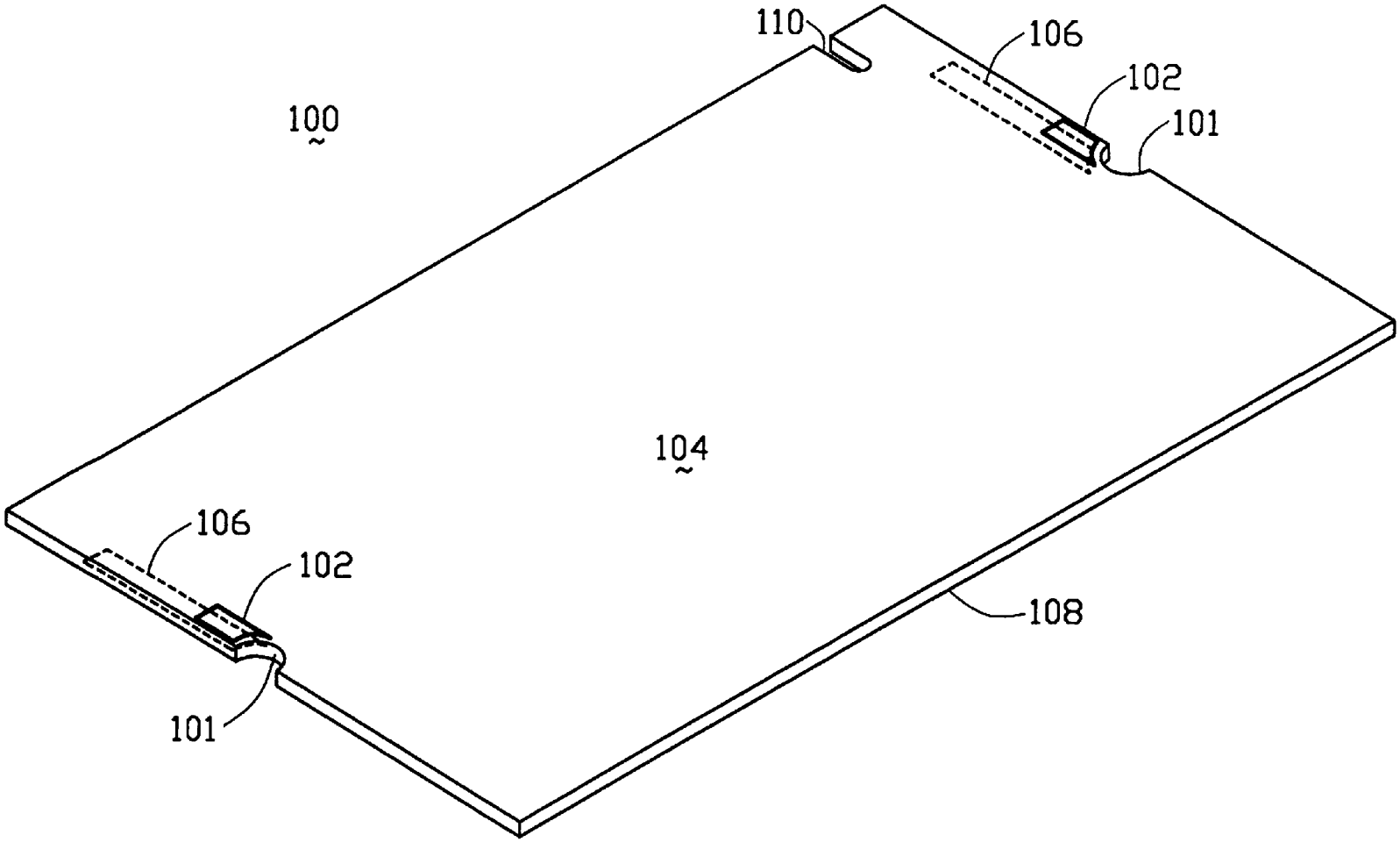
FIG. 3 is a perspective view of a substrate module use with the connector of FIG. 1.
Figure 4:
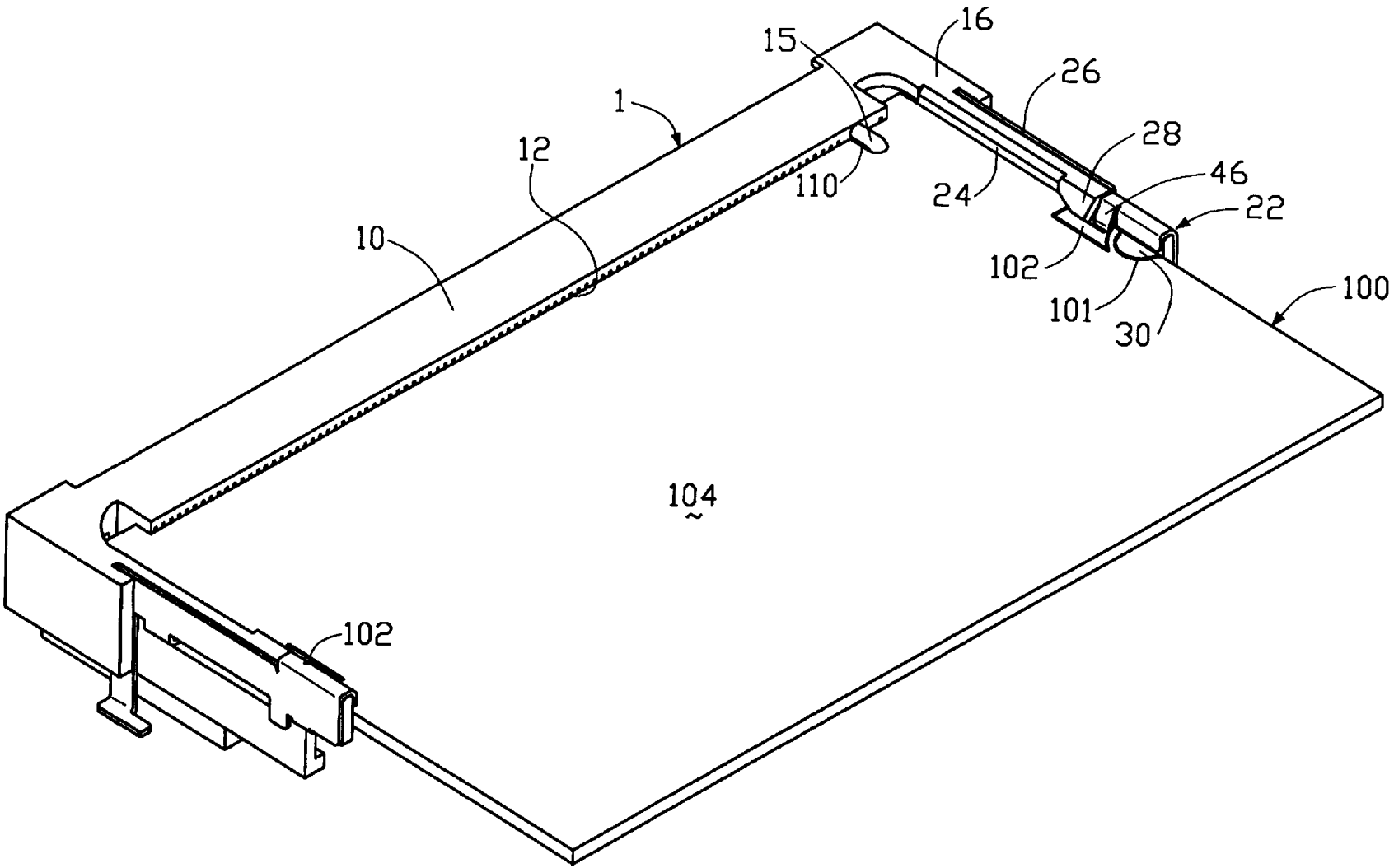
FIG. 4 is a perspective view of the connector of FIG. 3 with the substrate module of FIG. 3 therein.

It will be noted here that for a better understanding, most of like components are designated by like reference numerals throughout the various figures in the embodiments. Attention is directed to FIGS. 1 and 2 wherein an SO DIMM connector 1 includes an insulative housing 10 defining an elongated slot 12 along a longitudinal direction thereof. A plurality of passageways 14 are disposed by two sides of the slots 12 for receiving therein a plurality of contacts (not shown) wherein each contact extends into the slot for engagement with inserted module (illustrated later). A key 15 is formed within the slot 12 for orientation purpose.

A pair of supporting platforms 16 are located at two ends of the housing 10. The platform 16 defines a vertical groove 18 (partially shown) and a horizontal groove 20 therein.

A latch device 22 which is located unto each platform 16, includes a deflectable plastic member 24 and a deflectable metal member 26. The plastic member 24 integrally extends from the platform 16 and defines a locking protrusion 28 and a restriction protrusion 30 around the distal free end thereof. The metal member 26 includes a main body 32 with an engaging tag 34 for keeping main body 32 of the metal member 26 and the plastic member 24 synchronous with each other, and a barb section 36 extending forwardly therefrom for interferential engagement within the corresponding vertical groove 18 in the housing 10 so as to secure the metal member 26 to the housing 10.

The metal member 26 further includes a vertical section 38 with a horizontal mounting tab 40 at the bottom end for surface mounting to a mother board (not shown) on which the connector 1 is seated. An extension 42 extends horizontally from a lower edge 43 of the main body 32 and is inserted into the horizontal groove 20 with a lower grounding tang 44 extending rearwardly from the extension 42. An upper grounding tang 46 extends downwardly from an upper edge 47 of the main body 32 beside the engaging tag 34. A pair of restriction tags 48, 50 extends downwardly from the lower edge 43 of the main body 32 for respective engagement with two opposite sides of a stationary bar 52 of the platform 16 when said main body 32 of the metal member 26 is positioned at an innermost position and an outermost position. The arrangements/functions of the restriction tags 48 and 50 are illustrated in detail in the aforementioned U.S. Pat. No. 5,997,332.

When the metal member 26 is assembled to the plastic member 24, the barb section 38 is interferentially inserted into the corresponding vertical groove 18 and the extension 42 is received within the horizontal groove 20 with the lower grounding tang 44 obliquely extends rearwardly. The restriction tags 48, 50 are respectively located by two sides of the stationary bar 52. The engaging tag 34 is positioned above the restriction protrusion 30, and the upper grounding tang 46 is generally positioned between the locking protrusion 28 and the restriction protrusion 30.

A substrate module 100 includes a pair of notches 101 in two side portions thereof, two small grounding pads 102 on the upper surface 104, and two large grounding pads 106 on the bottom surface 108 wherein both the small grounding pad 102 and the large grounding pad 106 are located around each notch 101. A keyway 110 is formed in a front edge portion of the module 100 for engagement with the key 15,in the slot 12.

Similar to the existing SO DIMM connector, the module 100 is assembled to the housing 10 by insertion plus rotation of the module 100 with regard to the housing 10 associated with deflection of the latch device 22 under a condition that the two side portions of the module 100 passes over both the corresponding locking protrusions 28 and the upper grounding tangs 46 aside, wherein the upper grounding tang 46 and the lower grounding tang 44 are respectively engaged with the corresponding grounding pads 102 and 106, and the locking protrusion 28 is latchably engaged with the upper surface 104 of the module 100 for preventing upward movement of the module 100, while the restriction protrusion 30 is embedded within the corresponding notch 101 for preventing back-and-forth movement of the module 100 with regard to the housing 10.

It can be seen in comparison with the aforementioned U.S. Pat. No. 5,997,332, the invention rearranges the plastic member and the metal member of the latch device for providing the additional grounding function thereof while still keeping the advantages of the hybrid type latch device (i.e., plastic member plus metal member) disclosed in such a patent.

While the present invention has been described with reference to the specific embodiment, the description is illustrated of the invention and is not to be construed as limiting the invention. Various modifications to the present invention can be made to the preferred embodiment by those skilled in the art without departing from the true spirit and scope of the invention as defined by the appended claims. Therefore, person of ordinary skill in this filed are to understand that all such equivalent structures are to be included within the scope of the following claims.

I claim:

1. A card edge connector comprising:

an insulative housing defining an elongated slot along a longitudinal direction thereof;

a pair of supporting platforms located at two opposite ends of the housing;

a latch device disposed on each of said supporting platforms and including a deflectable plastic member and a deflectable metal member;

said plastic member integrally extending from the supporting platform with a locking protrusion and a restriction protrusion thereon;

said metal member attached to and actuated by said plastic member, and defining an engaging tag for synchronizing deflection of the metal member and the plastic member, a grounding tang extending from one of upper and lower edges thereof, and a vertical section with a mounting tab adapted to be mounted to a mother board on which the connector is mounted;

wherein said metal member includes a barb section for securing the metal member to the housing;

wherein said grounding tang is an upper grounding tang extending from the upper edge of the metal member and between said locking protrusion and said restriction protrusion;

wherein said grounding tang is a lower grounding tang extending from said lower edge of the metal member;

wherein said metal member further includes two restriction tags respectively positioned by two sides of a stationary bar of the supporting platform which is located below the corresponding plastic member.

2. A connector assembly comprising an insulative housing defining an elongated slot along a longitudinal direction thereof;

a pair of supporting platforms located at two opposite ends of the housing;

a latch device disposed on each of said supporting platforms and including a deflectable plastic member and a deflectable metal member;

said plastic member integrally extending from the supporting platform with a locking protrusion;

said metal member attached to and actuated by said plastic member, and defining an engaging tag adjacent to the locking protrusion for synchronizing deflection of the metal member and the plastic member, upper and lower grounding tangs respectively extending from upper and lower edges thereof, and a vertical section with a mounting tab adapted to be mounted to a mother board on which the connector is mounted; and a module received within the housing and defining upper and lower grounding pads on opposite upper and lower surfaces wherein said upper grounding tang engages the corresponding upper grounding pad, said lower grounding tang engages the corresponding lower grounding pad, and the locking protrusion abuts against the upper surface of the module;

wherein said module defines a pair of notches in two opposite side portions, and each plastic member includes a restriction protrusion for compliant engagement in the corresponding notch;

wherein said engaging tag is positioned above the corresponding restriction protrusion;

wherein said upper grounding tang is positioned between the corresponding locking protrusion and restriction protrusion;

wherein said metal member further includes two restriction tags respectively positioned by two sides of a stationary bar of the supporting platform which is located below the corresponding plastic member;

wherein the upper grounding tang is moved along with the plastic member and moveable with regard to the housing in said longitudinal direction, while said lower grounding tang is generally stationary with regard to the housing in said longitudinal direction;

wherein said metal member further includes a barb section for securing the metal member to the housing.

* * * * *